US008590702B2

(12) United States Patent
Lai

(10) Patent No.: US 8,590,702 B2
(45) Date of Patent: Nov. 26, 2013

(54) BASE STRUCTURE OF GOLF BAG

(76) Inventor: Wei Hung Lai, Taichung (TW)

( * ) Notice: Subject to any disclaimer, the term of this patent is extended or adjusted under 35 U.S.C. 154(b) by 0 days.

(21) Appl. No.: 13/338,919

(22) Filed: Dec. 28, 2011

(65) Prior Publication Data

US 2013/0168273 A1 Jul. 4, 2013

(51) Int. Cl.
*A63B 55/00* (2006.01)

(52) U.S. Cl.
USPC ..... 206/315.7; 428/96

(58) Field of Classification Search
USPC ..... 206/315.7; 248/96
See application file for complete search history.

(56) References Cited

U.S. PATENT DOCUMENTS 1,757,471 A * 5/1930 Platt ..... 248/96
5,857,567 A * 1/1999 Cheng ..... 206/315.7
6,098,797 A * 8/2000 Han ..... 206/315.7
6,315,117 B1 * 11/2001 Han ..... 206/315.7
6,435,345 B1 * 8/2002 Wang ..... 206/315.7
6,591,983 B1 * 7/2003 Chang ..... 206/315.7
6,817,469 B2 * 11/2004 Chang ..... 206/315.7

* cited by examiner

*Primary Examiner* — Tri Mai
(74) *Attorney, Agent, or Firm* — Muncy, Geissler, Olds & Lowe, PLLC

(57) ABSTRACT

A base structure of a golf bag includes an upper frame, a lower frame, a base and a bag connected between the upper frame and the lower frame. The upper frame is provided with an outer support to support the bag and an auxiliary rod to support the outer support. The base and the lower frame have corresponding pivot holes for insertion a shaft. The lower frame and the base are pivotally connected. The lower frame can be turned an angle relative to the base. The base further has a front pivot hole for pivot connection of the auxiliary rod. The lower frame has a front oblique surface. When the bag is placed at an angle, the lower frame will be turned an angle and the front oblique surface of the lower frame leans against the base so that the golf bag is placed steady.

1 Claim, 7 Drawing Sheets

BASE STRUCTURE OF GOLF BAG

BACKGROUND OF THE INVENTION

1. Field of the Invention

The present invention relates to a base structure of a golf bag, and more particularly to a golf bag which can be placed at an angle steady.

2. Description of the Prior Art

As shown in FIG. 1 through FIG. 3, a conventional golf bag structure comprises an upper frame 10, a base 11, a plurality of support poles 12 which are disposed between the upper frame 10 and the base 11 and wrapped by a piece of cloth or leather to from a bag 15. The upper frame 10 is provided with an outer support 13 to support the bag 15 to be placed at an angle for the user to take out the clubs easily. An auxiliary rod 14 is provided to support the outer support 13. The conventional golf bag structure has some drawbacks. As shown in FIG. 1 and FIG. 3, the ends of the support poles 12 are connected to the upper frame 10 and the base 11, respectively. When the golf bag is placed at an angle, the base 11 will be tilted at an angle of θ, In other words, only one end of the base 11 is against the ground, not the whole of the base 11. In this way, the golf bag is unstable and may topple over. Accordingly, the inventor of the present invention has devoted himself based on his many years of practical experiences to solve these problems.

SUMMARY OF THE INVENTION

The primary object of the present invention is to provide a base structure of a golf bag which comprises an upper frame, a lower frame, a base and a bag connected between the upper frame and the lower frame. The upper frame is provided with an outer support to support the bag and an auxiliary rod to support the outer support. The base and the lower frame have corresponding pivot holes for insertion a shaft. The lower frame and the base are pivotally connected. The lower frame can be turned an angle relative to the base. The base further has a front pivot hole for pivot connection of the auxiliary rod. The lower frame has a front oblique surface. When the bag is placed at an angle, the lower frame will be turned an angle and the front oblique surface of the lower frame leans against the base so that the golf bag is placed steady.

DETAILED DESCRIPTION OF THE PREFERRED EMBODIMENTS

Figure 1:
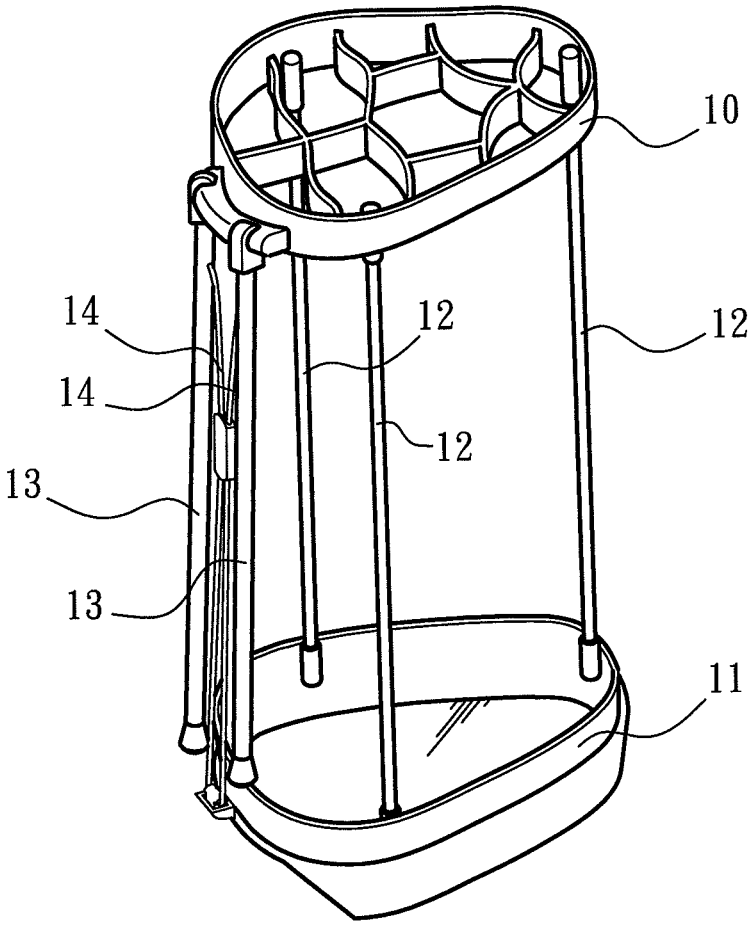
FIG. 1 PRIOR ART
FIG. 1 is a perspective view of a conventional golf bag structure.
Figure 2:
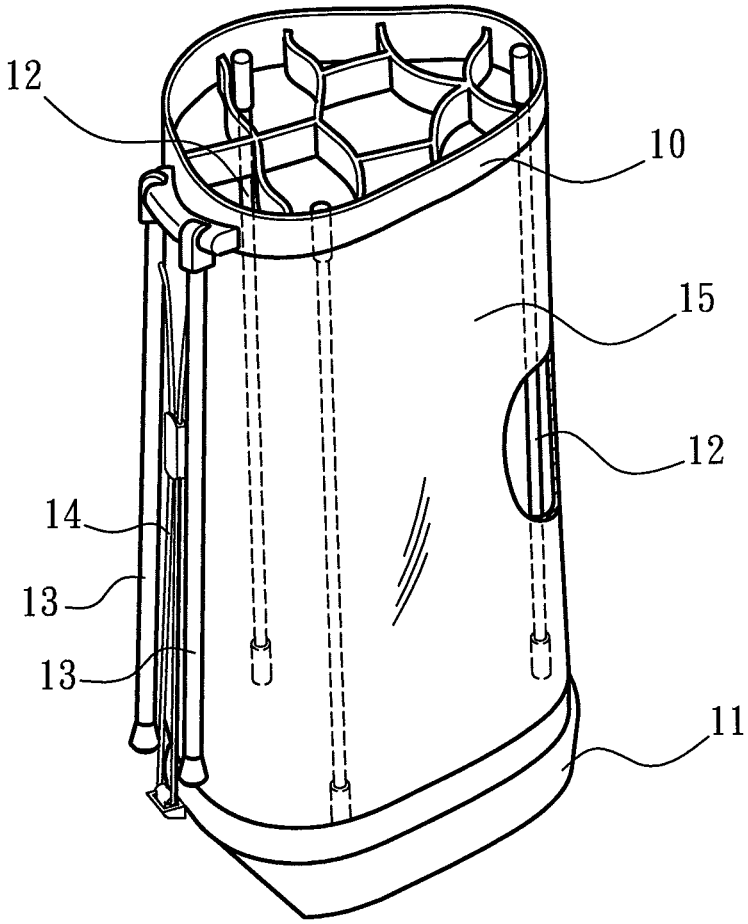
FIG. 2 PRIOR ART
FIG. 2 is a perspective view of the conventional golf bag.
Figure 3:
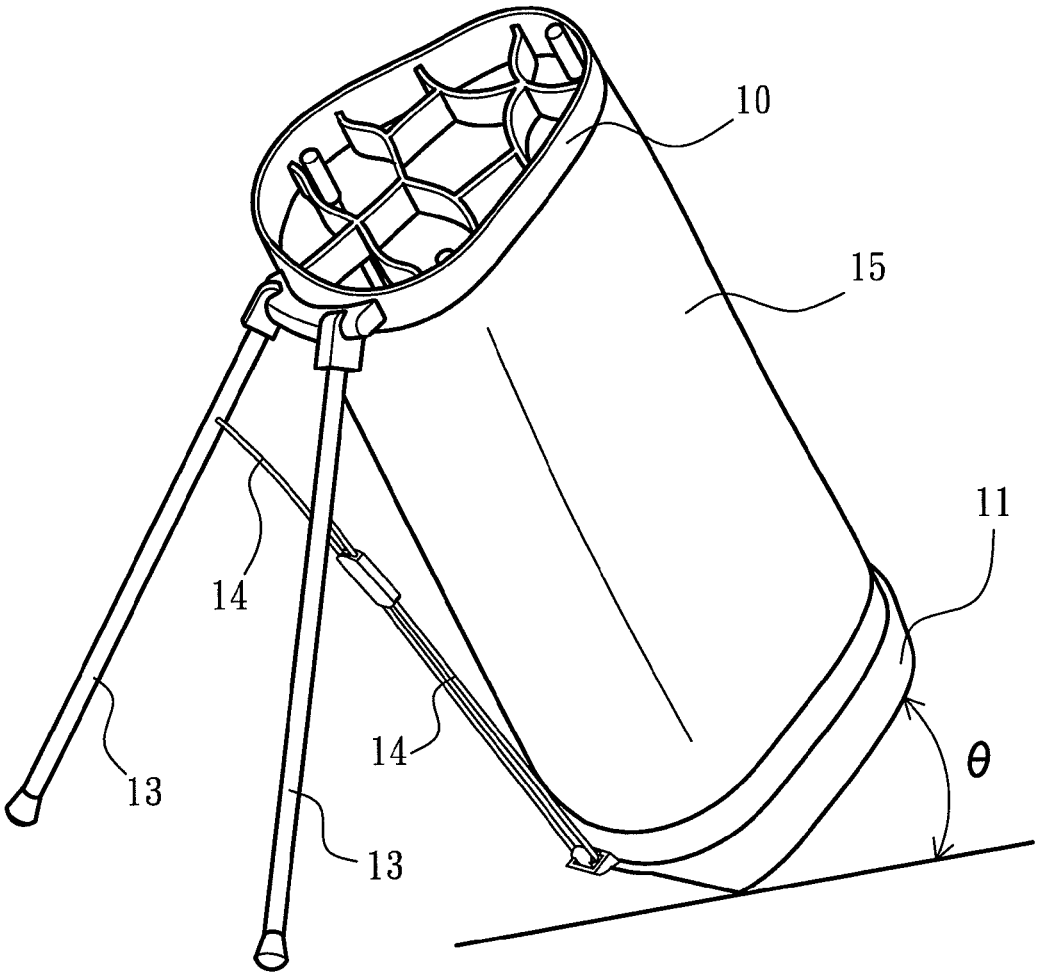
FIG. 3 PRIOR ART
FIG. 3 is a schematic view of the conventional golf bag placed at an angle.
Figure 4:
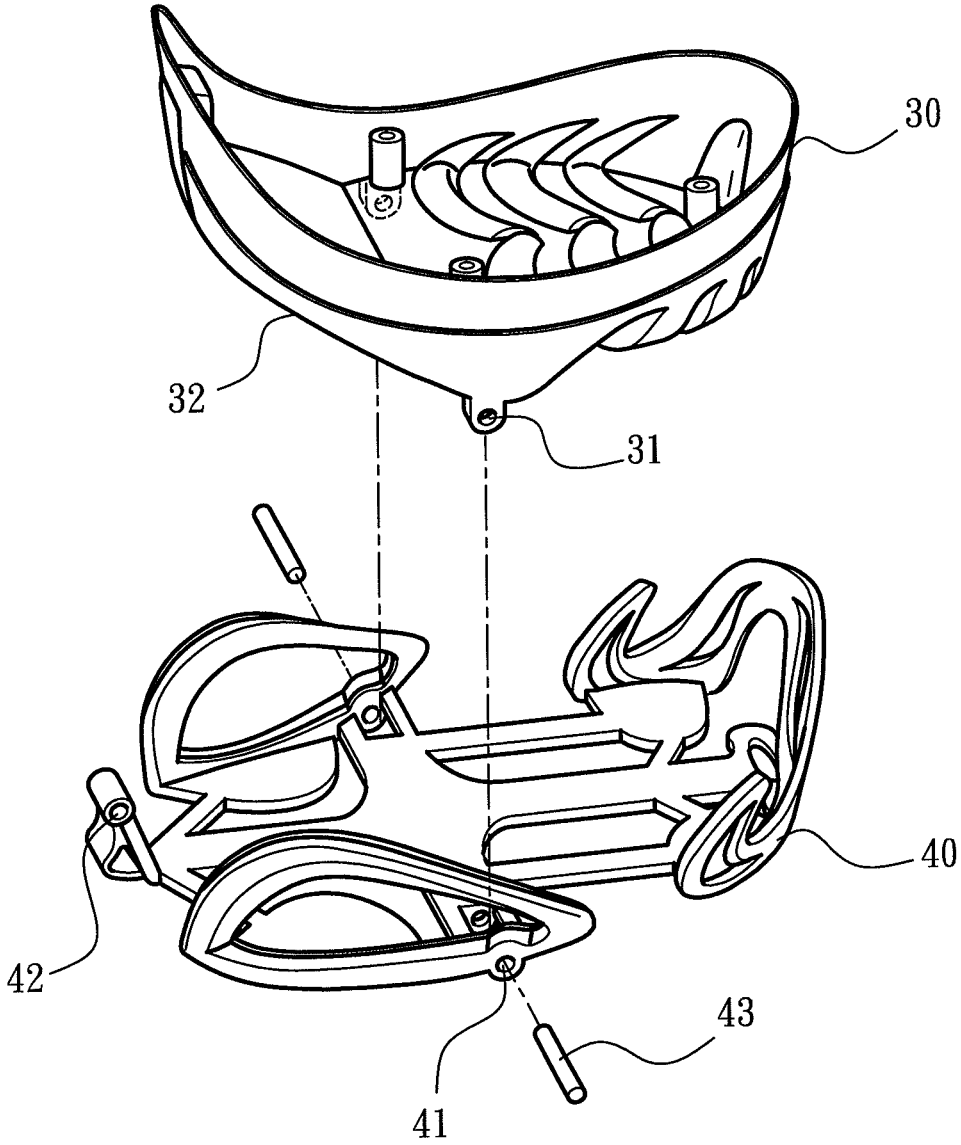
FIG. 4 is an exploded view showing the lower frame and the base of the present invention.

Embodiments of the present invention will now be described, by way of example only, with reference to the accompanying drawings.

As shown in FIG. 4 through FIG. 7, the present invention comprises an upper frame 20, a lower frame 30, a base 40, and a bag 25 connected between the upper frame 20 and the lower frame 30. The upper frame 20 is provided with an outer support 23 to support the bag 25 and an auxiliary rod 24 to assist in supporting the outer support 23. The base 40 and the lower frame 30 have corresponding pivot holes 41, 31 for insertion a shaft 43, so that the lower frame 30 and the base 40 are pivotally connected. The lower frame 30 can be turned an angle relative to the base 40. The base 40 further has a front pivot hole 42 for pivot connection of the auxiliary rod 24. The lower frame 30 has a front oblique surface 32.

Figure 5:
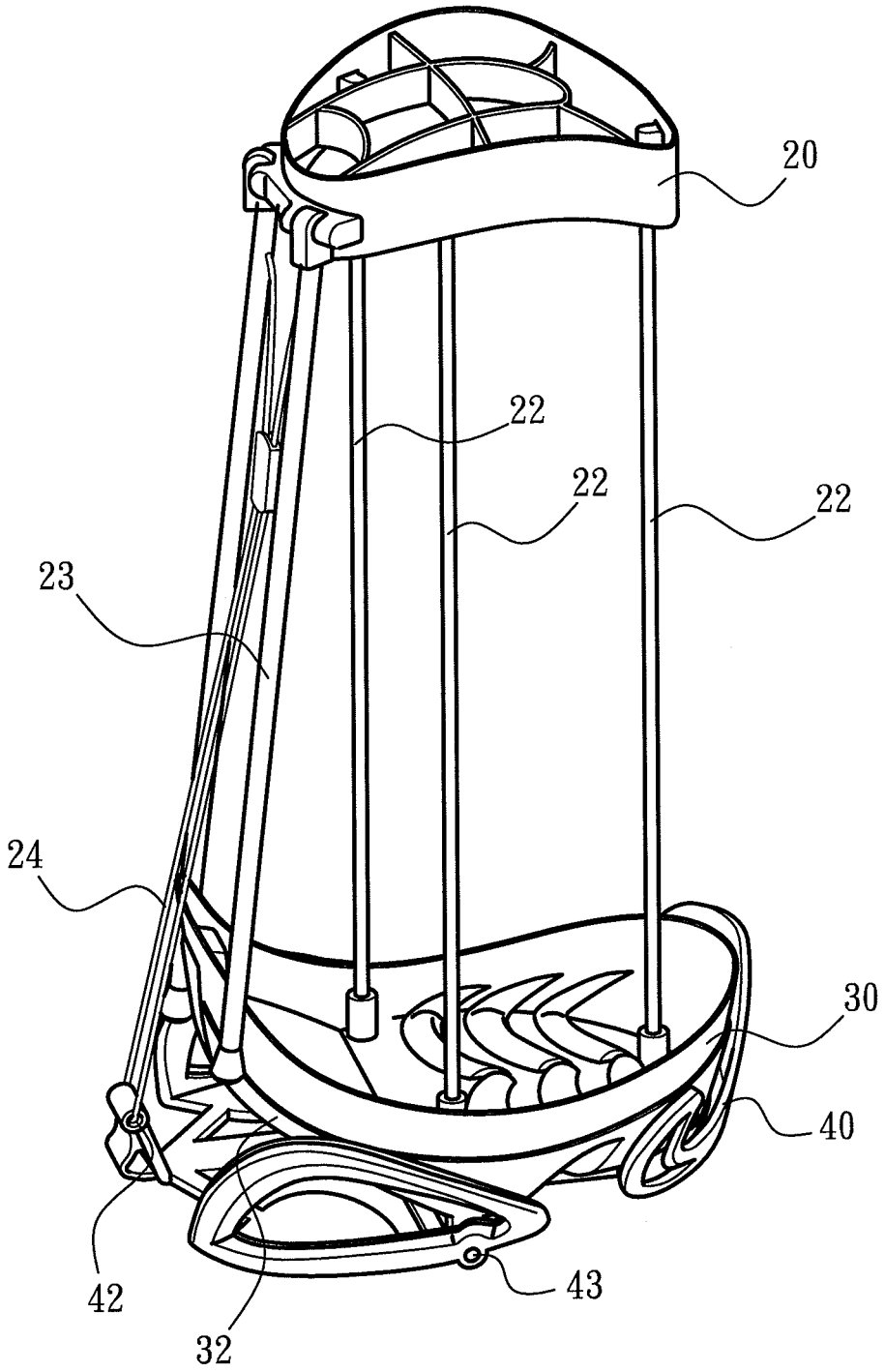
FIG. 5 is a perspective view of the present invention.
Figure 6:
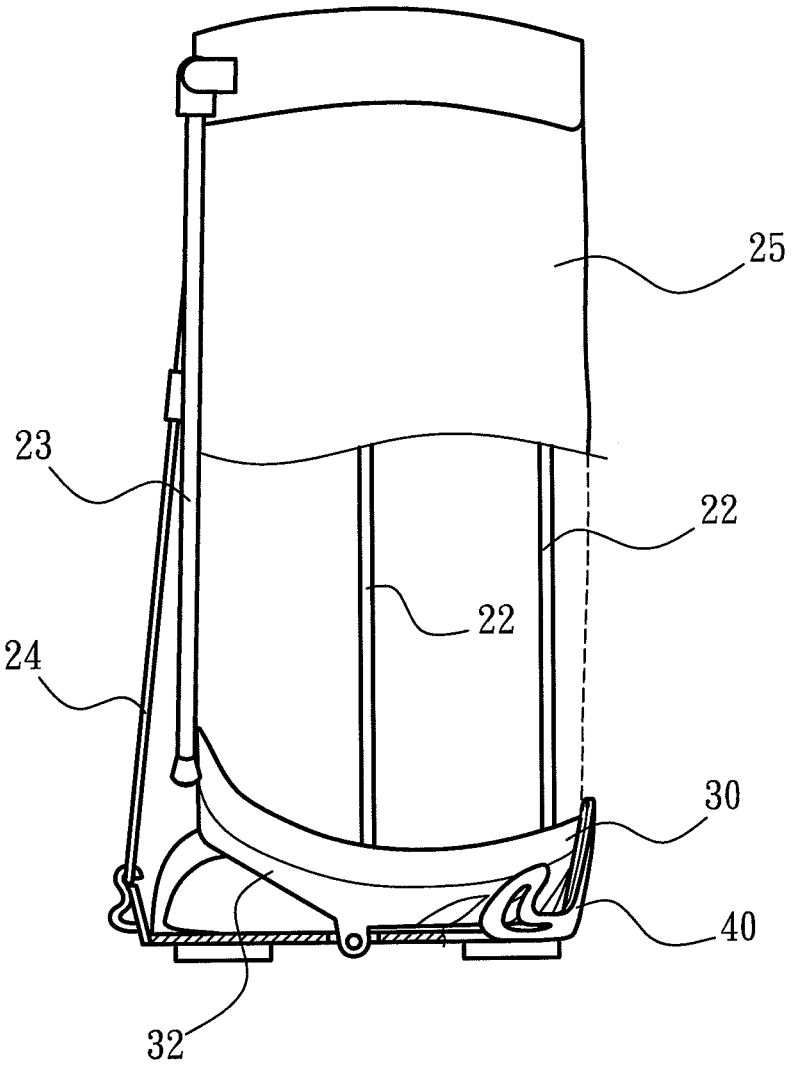
FIG. 6 is a perspective view of the present invention placed upright.
Figure 7:
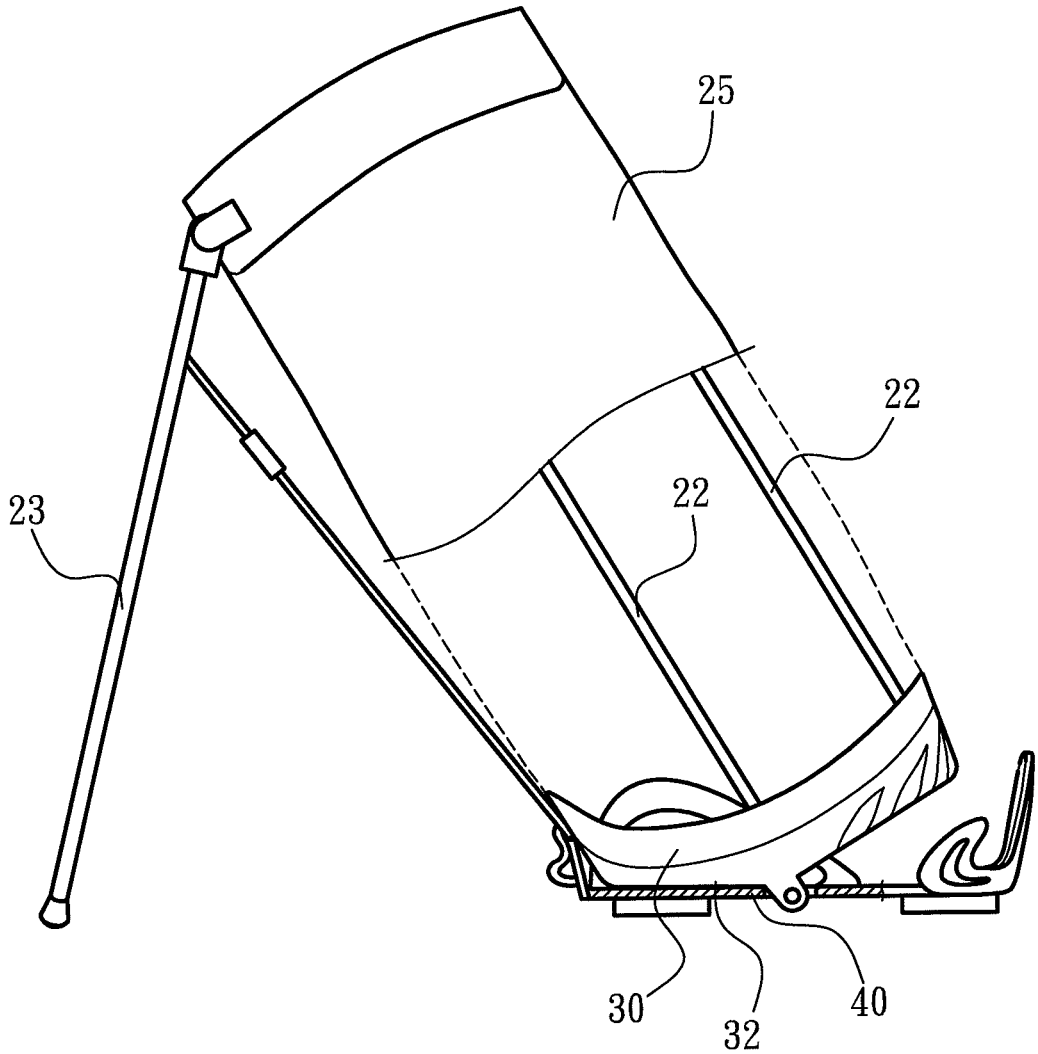
FIG. 7 is a perspective view of the present invention placed at an angle.

According to the aforesaid structure, the present invention has the following effects. When the bag 25 is placed upright as shown in FIG. 5 and FIG. 6, the rear portion of the lower frame 30 will lean against the base 40 for an inner support 22 to be placed upright. When the bag 25 is placed at an angle as shown in FIG. 7, the lower frame 30 is rotatable and has the front oblique surface 32 for the lower frame 30 to be inclined. The front oblique surface 32 of the lower frame 30 can be fully against the base 40. In other words, the lower frame 30 won't be tilted as the prior art. The golf bag of present invention can be placed at an angle steady.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A base structure of a golf bag, comprising:

a lower frame; and a base;

the lower frame comprising a flat bottom surface, a front oblique surface and a circular side frame, the flat bottom surface having a pair of first pivot holes close to the front oblique surface and extending downwardly from the lower frame, the front of the side frame having a recess;

the base receiving the lower frame entirely and being connected thereto, so that the lower frame does not contact the ground, the base having a pair of second pivot holes at left and right sides thereof, the first pivot holes being aligned with the second pivot holes, a shaft being inserted through each set of the first and second pivot holes to connect the lower frame and the base so that the lower frame pivots about the shaft, so that when the bag is inclined, the lower frame is also inclined, so that the front oblique surface of the lower frame rests against the base stably, and a bottom surface of the base is fixed on the ground horizontally regardless of the lower frame being vertical or oblique so that a position of the base is independent of a position of the lower frame;

a front pivot hole disposed at a front end of the base, wherein when the front oblique surface of the lower frame is inclined, the recess of the side frame covers the front pivot hole.

* * * * *